US006711857B1

(12) United States Patent
Wagnitz et al.

(10) Patent No.: US 6,711,857 B1
(45) Date of Patent: Mar. 30, 2004

(54) INFANT SAFETY GATE WITH REMOTE LATCH ACTIVATING MECHANISM

(75) Inventors: Kurt P. Wagnitz, Coleman, WI (US); Patrick G. McCutcheon, Green Bay, WI (US)

(73) Assignee: Evenflo Company, Inc., Vandalia, OH (US)

( * ) Notice: Subject to any disclaimer, the term of this patent is extended or adjusted under 35 U.S.C. 154(b) by 0 days.

(21) Appl. No.: 09/666,694

(22) Filed: Sep. 21, 2000

(51) Int. Cl.[7] ..... E05B 65/06
(52) U.S. Cl. ..... 49/394; 49/50
(58) Field of Search ..... 49/25, 463, 465, 49/50, 55, 394; 292/341.15, 341.16

(56) References Cited

U.S. PATENT DOCUMENTS

| | | | | | |
|---|---|---|---|---|---|
| 1,417,430 | A | * | 5/1922 | Tulloch et al. | 292/201 |
| 2,218,183 | A | * | 10/1940 | Springer | 70/149 |
| 3,211,850 | A | * | 10/1965 | Toepfer | 200/61.64 |
| 3,774,422 | A | * | 11/1973 | Hogan et al. | 70/264 |
| 3,804,442 | A | * | 4/1974 | Powers | 292/341.16 |
| 3,861,727 | A | * | 1/1975 | Froerup et al. | 292/341.16 |
| 4,211,443 | A | * | 7/1980 | Butts et al. | 292/341.16 |
| 4,231,190 | A | | 11/1980 | Tieben | |
| 4,427,975 | A | * | 1/1984 | Kinzie | 340/547 |
| 4,495,730 | A | | 1/1985 | Kennedy | |
| 4,497,135 | A | | 2/1985 | Vetter | |
| 4,520,592 | A | | 6/1985 | Holloway | |
| 4,626,010 | A | * | 12/1986 | Hanchett et al. | 292/341.16 |
| 4,658,543 | A | * | 4/1987 | Carr | 49/139 |
| 4,667,440 | A | | 5/1987 | Grace, Sr. | |
| 4,702,036 | A | | 10/1987 | Johnson | |
| 4,793,098 | A | * | 12/1988 | Wilkerson | 49/55 |
| 4,884,614 | A | * | 12/1989 | Spurling | 160/225 |
| 4,887,205 | A | | 12/1989 | Chou | |
| 4,907,429 | A | | 3/1990 | Davis et al. | |
| 5,261,260 | A | | 11/1993 | Lin | |
| 5,474,342 | A | | 12/1995 | Smith et al. | |
| 5,490,698 | A | | 2/1996 | Dezso | |
| 5,575,515 | A | * | 11/1996 | Iwamoto et al. | 292/341.17 |
| 5,681,070 | A | * | 10/1997 | Williams et al. | 292/341.16 |
| 5,722,114 | A | | 3/1998 | Lapp, Jr. et al. | |
| 5,729,198 | A | | 3/1998 | Gorman | |
| 5,809,694 | A | | 9/1998 | Postans | |
| 5,881,497 | A | | 3/1999 | Borgardt | |
| 5,910,075 | A | * | 6/1999 | Arnell et al. | 49/25 |
| 5,927,769 | A | * | 7/1999 | Pullen | 292/169.13 |
| 5,987,818 | A | | 11/1999 | Dabideen | |
| 6,016,629 | A | * | 1/2000 | Sylvester et al. | 49/55 |
| 6,022,056 | A | | 2/2000 | Cope et al. | |
| 6,027,148 | A | * | 2/2000 | Shoemaker | 292/216 |
| 6,079,157 | A | * | 6/2000 | Hincher, Sr. | 49/57 |
| 6,233,874 | B1 | * | 5/2001 | Johnson, Jr. | 49/465 |
| 6,253,490 | B1 | * | 7/2001 | Postans | 49/55 |

FOREIGN PATENT DOCUMENTS

| | | |
|---|---|---|
| DE | 20007552 | 8/2000 |

* cited by examiner

*Primary Examiner*—Gregory J. Strimbu
(74) *Attorney, Agent, or Firm*—Taft, Stettinius & Hollister LLP

(57) ABSTRACT

An infant gate including a remotely activated latch mechanism. The gate includes a gate member adapted to be pivotally mounted to a wall portion and is movable to a closed position to prevent an infant from passing therethrough. The latch movable is between a locked position, which prevents pivotable movement of the gate, and an unlocked position, which allows pivotable movement of the gate. The gate also includes an actuator for switching the latch to the unlocked position. The actuator is preferably mounted away from the gate member in a position generally inaccessible to an infant whose access is limited by the infant gate.

8 Claims, 7 Drawing Sheets

FIG. 1

INFANT SAFETY GATE WITH REMOTE LATCH ACTIVATING MECHANISM

The present invention is directed to infant safety gates, and more particularly, to infant security gates having a remote latch activating mechanism.

BACKGROUND OF THE INVENTION

Infant safety gates are widely used to prevent children, particularly infants, from entering a desired area such as a stairwell, or from leaving a desired area such as a playroom or nursery. The gate typically is adjustable between a closed position, wherein the gate blocks the opening and prevents access through the opening, and an open position wherein the gate does not block the opening. In some designs, the gate is attached at one end to a wall or doorway by hinges so that it can swing open or closed. Such gates also include a mechanism at an opposite end to latch the gate in the closed position.

The latch mechanisms for such gates are preferably secure and robust to ensure that the latch mechanism is not accidentally activated, or activated by the infant. Existing latch mechanisms are configured to require a relatively high activation force or complex manual manipulation in order to address this issue. Furthermore, existing latch mechanisms are typically located on the gates themselves, and therefore may located at a relatively low height which may be difficult for an adult to access.

Accordingly, there is a need for an infant safety gate having a latch activating mechanism which is relatively easy to access and operate by an adult, but difficult to be accessed by a child.

SUMMARY OF THE INVENTION

The present invention is an infant safety gate having a latch mechanism which is convenient for an adult to access and operate. The invention includes a latch mechanism which can be activated from a location remote from the gate structure by the touch of a button. The button can be positioned to be out of the reach of an infant but easily accessed and operated by an adult.

In a preferred embodiment, the invention is an infant safety gate having a remote latch activation mechanism which includes a gate member shaped to be pivotably mounted to a wall and being movable between an open position and a closed position. The latch activation mechanism includes a latch that is adjustable between a locked position, wherein pivotal movement of the gate member is prevented, and an unlocked position wherein pivotal movement of the gate member is permitted. The latch activation mechanism also includes an actuator for switching the latch to the unlocked position. The actuator preferably is located in a position which is inaccessible to an infant whose movement is to be limited by the gate.

Accordingly, it is an object of the present invention to provide an infant security gate having a latch mechanism which can be remotely activated easily by an adult, while being inaccessible by the child to be restrained by the gate. It is a further object of the present invention to provide an infant security gate having a latch mechanism that securely locks the gate in place. Other objects and advantages of the present invention will be apparent from the following description, the accompanying drawings and the appended claims.

DETAILED DESCRIPTION

Figure 1:
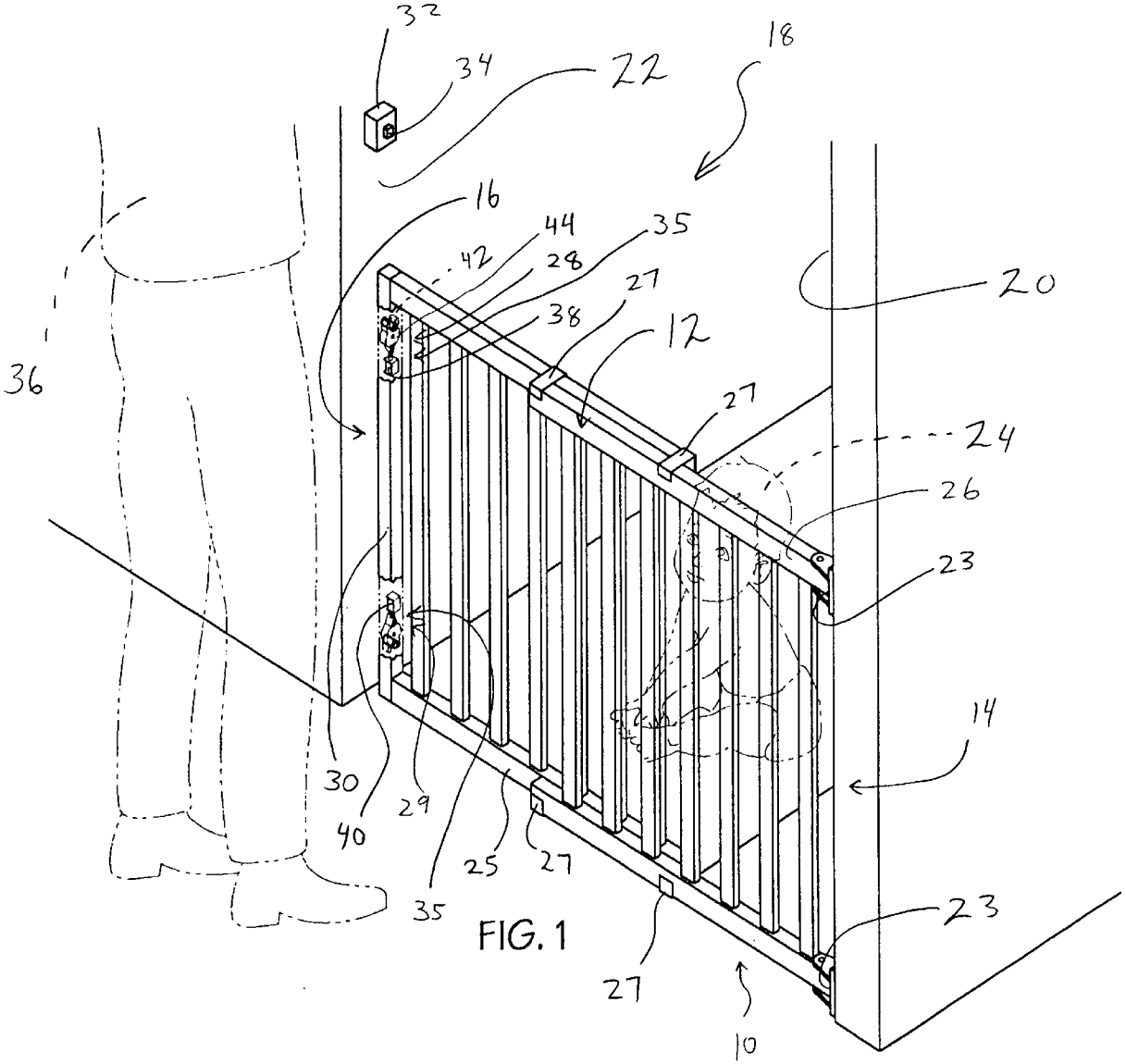
FIG. 1 is a perspective view illustrating a preferred embodiment of the infant safety gate of the present invention.

As shown in FIG. 1, the present invention, generally designated 10, is an infant safety gate having a gate member 12 with a pivot side 14 and latch side 16. The gate 10 is shown mounted to a doorway 18 located between opposing wall portions 20 and 22 of the doorway. However, the gate 10 can to be mounted to a variety of openings besides the doorway 18 shown herein, such as an opening to a stairwell, without departing from the scope of the invention. The pivot side 14 of the gate member 12 is pivotally mounted to the wall portion 20 by hinges 23. The gate 10 is shown in its closed position wherein the latch side 16 of the gate member 12 is located adjacent to the wall portion 22. When latched in the closed position, the gate 10 prevents an infant 24 from passing through the doorway 18. In the preferred embodiment, the gate member 12 includes gate panels 25, 26 which are slidably connected to each other by brackets 27. Consequently, gate member 12 can be adjusted in length to fit doorway 18 by slidably adjusting gate panels 25, 26 relative to each other.

The gate 10 includes a pair of latch mechanisms 28, 29 that selectively attach the latch side 16 of the gate member 12 to the wall portion 22 to lock the gate 10 in a closed position. Latch mechanisms 28, 29 are located in a generally vertically-extending housing 30 coupled to the latch side 16 of the gate member 12. Each latch mechanism 28, 29 is actuatable between a locked position, wherein pivotal movement of the gate member 12 is prevented, and an unlocked position, wherein pivotal movement of the gate member is permitted.

As will be explained in detail, each latch mechanism 28, 29 is remotely actuated by an actuator 32 that is positioned away from the latch mechanisms and gate member. The actuator 32 preferably is located at a position generally inaccessible to the infant 24, such as on the wall portion 22 or other surface at a height beyond the reach of the infant. The actuator 32 may also be located at a lower position, provided that it is located in an area not accessible to the infant 24. Each latch mechanism 28, 29 includes a receiver 35 that receives a signal sent by the actuator 34.

Figure 1A:
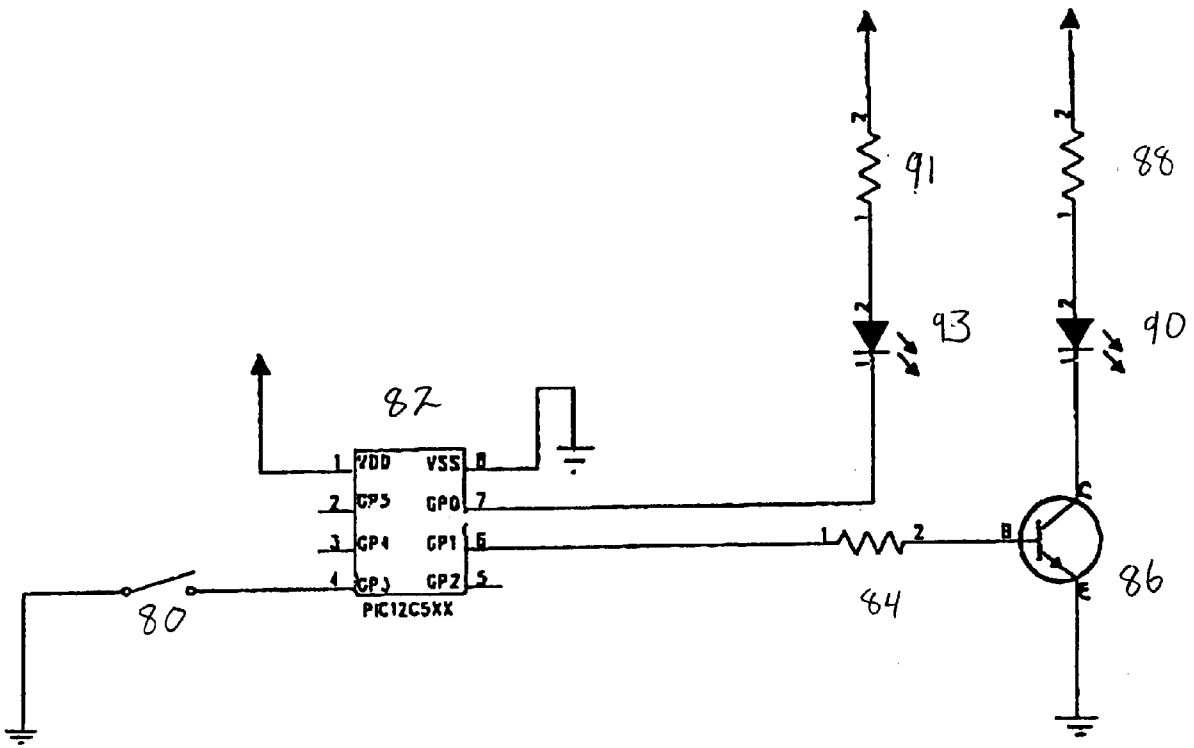
FIG. 1A is a schematic representation of a circuit used with the actuator of the present invention.

FIG. 1A illustrates a preferred circuit used with the actuator 34 to control operation of the gate. The circuit includes a switch 80 which is associated with an input of a micro controller 82. The micro controller 82 includes an output connected through a resistor 84 to control the on/off state of a transistor 86. A resistor 88 and infrared emitter 90 are connected in line with the transistor 86. A Panasonic model LN66A infrared emitter may be used as the emitter 90. A resistor 91 and LED 93, which can emit visible light, are also connected to the micro controller 82.

When the switch 80 is open, the micro controller 82 maintains the transistor 86 in its off position so that the infrared emitter 90 does not emit any infrared signals. The micro controller 82 also maintains LED 93 in its off position so that the LED 93 does not emit any visible light when the switch 80 is open. When the switch 80 is closed (i.e., by pressing button 34), the micro controller 82 turns on the LED 93 and also switches transistor 86 on in a pulsed manner to produce a code infrared signal. The infrared signal is preferably an 8 bit code modulated at 30 Khz, and each code bit is 1 ms in duration. A digital 1 code bit is preferably transmitted as a 0.5 ms modulated pulse followed by a 0.5 ms delay. A digital 0 code bit is preferably transmitted as a 0.5 ms gap (no signal) followed by a 0.5 ms delay, which is the same as a 1.0 ms delay. After the full eight bits have been transmitted there is a delay of 30 ms. If the switch 80 is still closed after the 30 ms delay, the micro controller 82 transmits the 8 bit code again.

Figure 1B:
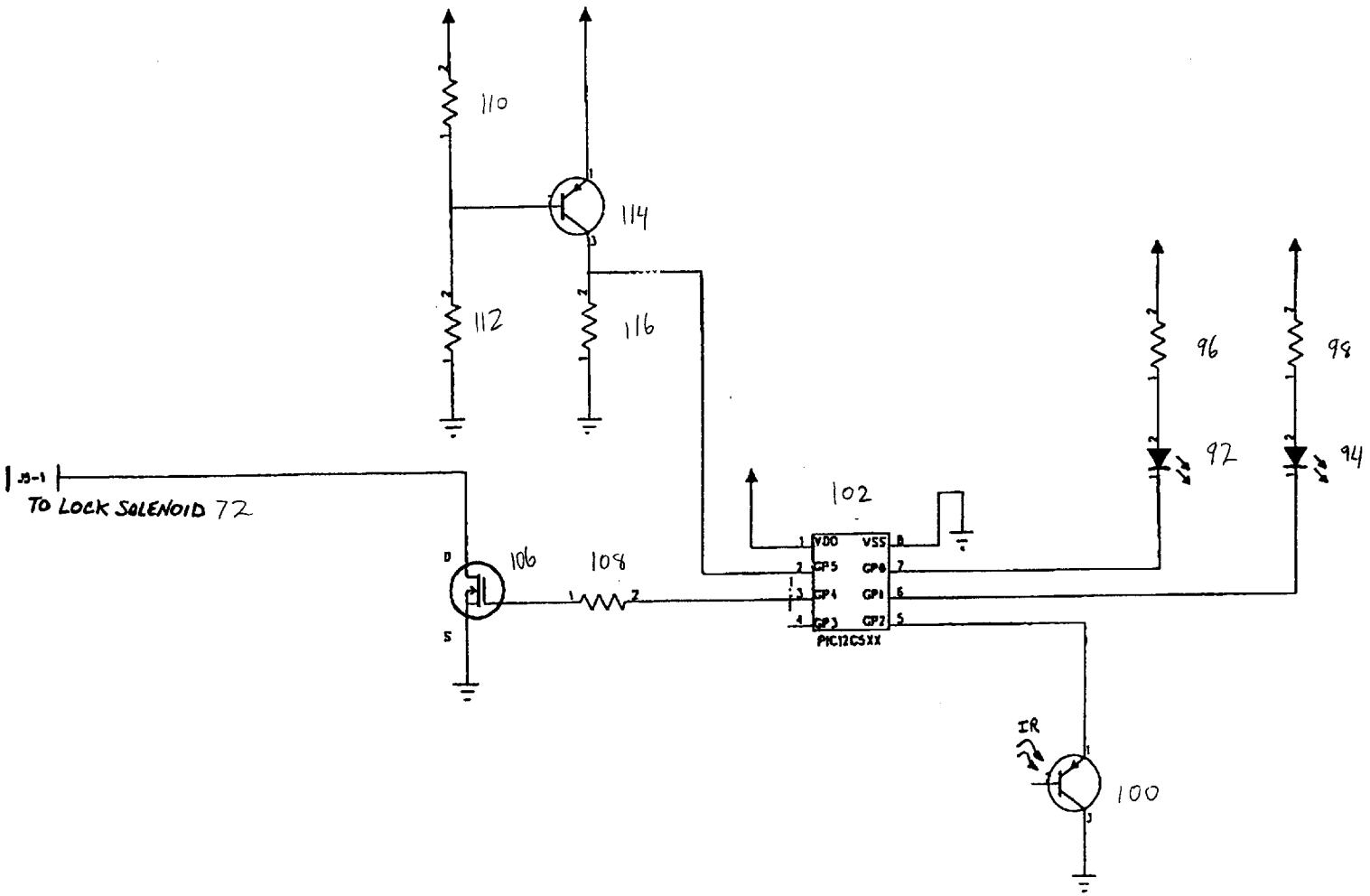
FIG. 1B is a schematic representation of a circuit used with the receiver of the present invention.

FIG. 1B illustrates a preferred circuit for use with a receiver 35 of a latch mechanism 28, 29. The circuit includes a green LED 92 and a red LED 94 connected in line with respective resistors 96 and 98. A micro controller 102 controls the on/off state of the LEDs 92, 94. The on/off state of the infrared detector 100 is controlled by the presence or absence of an infrared signal. The infrared detector 100 is preferably a Siemens model SFH 5110-30 infrared detector. When no infrared signal is detected, the detector 100 remains off. When an infrared signal is received, the detector 100 is turned on and an input to the micro controller 102 is pulled low. The micro controller 102 interprets the low input as a digital 1 coded bit. When the leading edge of such a digital 1 coded bit is received, the micro controller 102 delays for 250 $\mu$s to center on the code pulse. The micro controller 102 then observes the state of infrared detector 100 to test each bit for the correct 0 or 1 state according to an acceptable code stored therein and to check for the appropriate off state during each 0.5 ms delay. If the correct 8 bit sequence is observed by the micro controller 102, a two-second duration high voltage is applied to the gate of transistor 106 through resistor 108 to energize the gate solenoid, which is connected in line with transistor 106. The transistor 106 is turned on at full, constant voltage for 0.25 seconds to provide sufficient force to activate the solenoid 72. For the remaining 1.75 seconds, a 33% PWM voltage is applied to the gate of transistor 106. At the same time that the solenoid 72 is energized, green LED 92 is also turned on to indicate that the gate can be opened. If an incorrect code bit or other error is detected by the micro controller 102, the solenoid 72 is not activated.

The circuit of FIG. 1B also includes low battery power detection provided by the voltage divider formed by resistors 110 and 112 which are arranged to turn off transistor 114 when the battery power falls below a certain level. The micro controller 102 monitors the voltage across resistor 116 which is high when transistor 114 is on, and is low when transistor 114 is off. When the voltage across 116 drops, the micro controller 102 turns on the red LED 94 to indicate that the battery should be replaced.

Both micro controllers 82 and 102 preferably include associated dip switches which allow the user to set the desired 8 bit digital code. Of course, in operation the infrared emitter 90 should be positioned to direct its IR signal toward the IR detector 100. It should be understood that the circuits described and shown herein are only one mechanism for controlling operation of the gate, and other methods or layouts of circuits, or software or other controllers may be used without departing from the scope of the invention.

FIGS. 2–10 illustrate, in greater detail, one latch mechanism 28 which may be used in conjunction with the present invention. However, it is to be understood that the latch mechanism illustrated in FIGS. 2–10 and described herein is only one latch mechanism that may be used with the present invention. It should be further understood that a variety of gates, actuators and other hardware beyond the gates, actuators and hardware specifically described and shown herein may be used without departing from the scope of the present invention.

Figure 2:
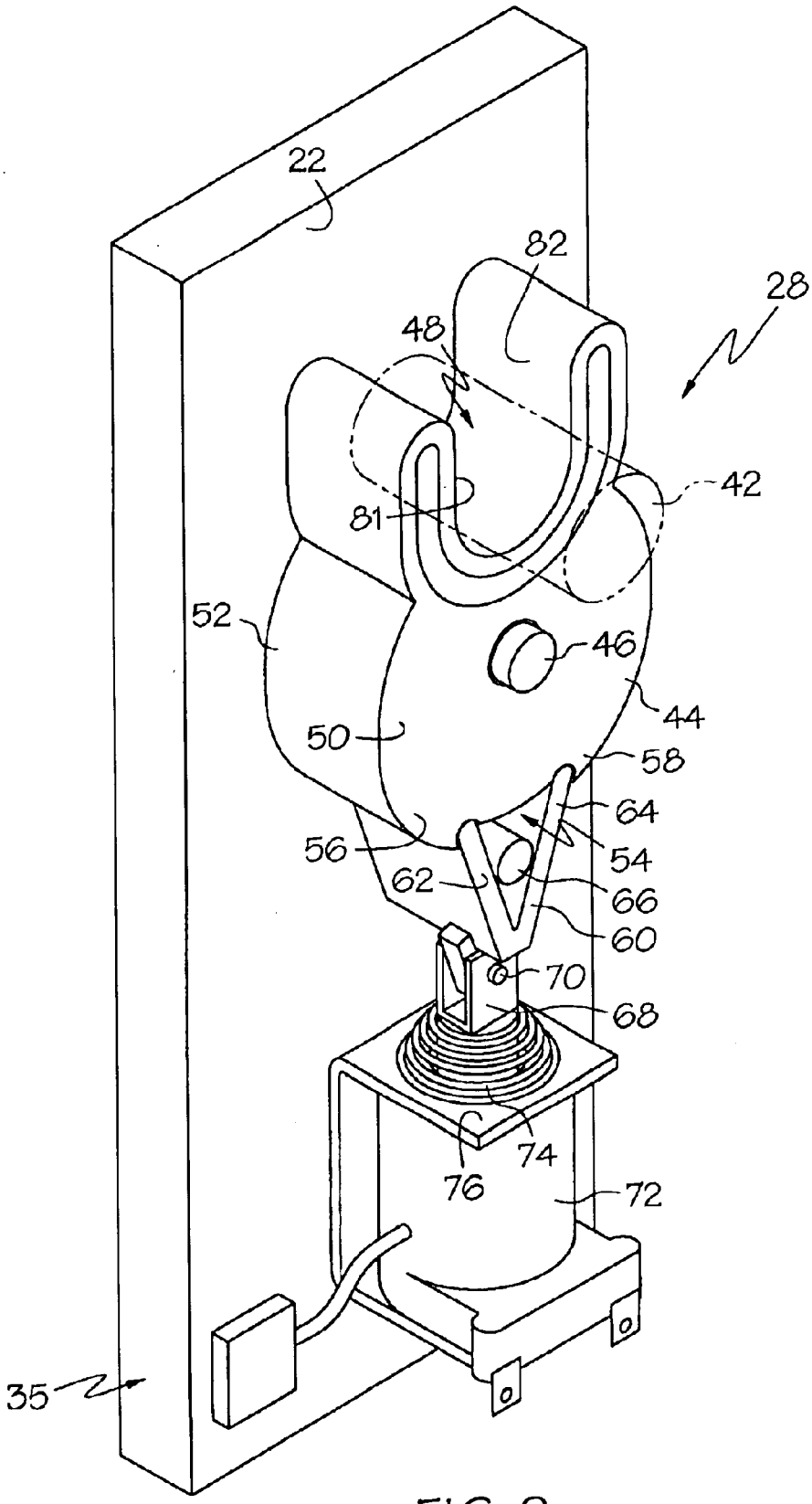
FIG. 2 is a perspective view of a detail of the gate shown in FIG. 1, showing one embodiment of the latch mechanism.
Figure 6:
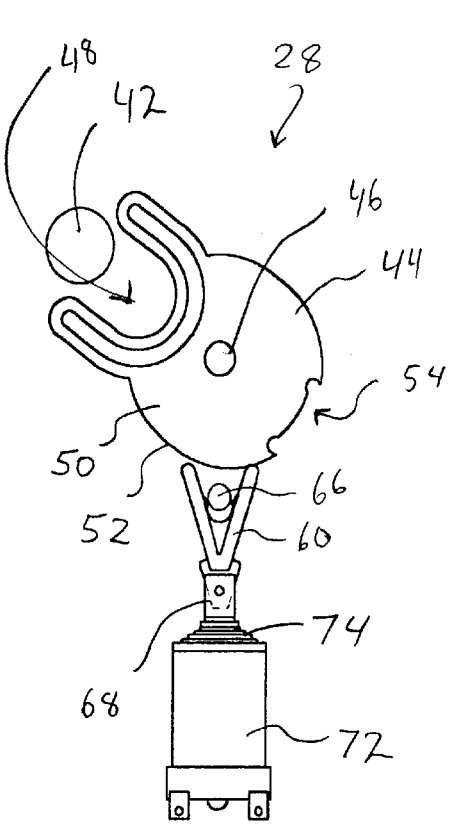
FIGS. 3–10 are front elevational views of the latch mechanism of FIG. 2, illustrating a sequence of operations to unlatch and latch the latch mechanism.

The latch mechanism 28 selectively latches the gate 10 to the wall portion 22. As shown in FIG. 2, the latch mechanism or latch 28 includes a protruding portion, or pin 42, coupled to the wall portion 22, and also includes a receiving portion, or cam 44, located on the gate 10. The cam 44 is pivotably mounted about a center rod 46, and includes a generally "U"-shaped slot 48 shaped to receive the pin 42 therein. The rotatable cam 44 includes a generally circular portion 50 having an outer face 52, the outer face 52 including a notch 54 located opposite the slot 48. The generally circular portion 50 is not precisely circular in top view, but includes a pair of radially outwardly protruding lobes 56, 58 on either side of the notch. The protrusion of the lobes 56, 58 in the illustrated embodiment is slight, and may not be visible in the drawings.

The latch mechanism 28 further includes a locking arm 60 that is movable into and out of engagement with the rotatable cam 44 to selectively block rotation of the cam. The locking arm 60 is movable in a radial direction relative to the circular portion 50 of the cam. The locking arm 60 includes a pair of legs 62, 64 arranged in a generally "V" shape, and a blocking rod 66 is received between the legs. The locking arm 60 is pivotably coupled to a piston 68 by a connecting pin 70, and the locking arm is free to pivot about the connecting pin. However, the blocking rod 66 limits the pivotal movement of the locking arm 60 about the connecting pin 70.

The locking arm 60 is coupled to the piston 68 of a solenoid 72, and the solenoid is in turn operatively coupled to the receiver 35. Thus, the solenoid 72 controls movement of the locking arm 60 into and out of engagement with the rotatable cam 44. A spring 74 is located between the end of the piston 68 and a plate 76 mounted onto the solenoid 72 to spring bias the locking arm 60 into engagement with the rotatable cam 44. As noted earlier, the solenoid 72, locking arm 60 and cam 44 are all received in the housing 30 of the gate.

When an adult 36 wishes to open the gate 10, the adult actuates the actuator 32 by pressing the button 34, which causes the transmitter 90 to emit a signal. The signal is received by the infrared detectors 100 of the receivers 35 of each latch mechanism 28, 29, which then trigger the respective solenoid 72 of each latch mechanism. Each solenoid 72 then causes its associated latch mechanism 28, 29 to move to its unlatched or unlocked position. The adult 36 may then pivot the gate 10 to its open position and walk through the gate, and the gate is then returned to its closed position. The gate 10 may be biased to return to its closed position, or alternately, the adult 36 may manually return the gate to its closed position. The latch mechanisms 28, 29 are then activated to switch to their locked positions, thereby locking the gate 10 in its closed position.

The latch mechanisms 28, 29 may each include a timer such that the latch mechanisms return to their locked positions after a predetermined period of time after the button 34 is activated, such as between 3–10 seconds. However, various other methods or mechanisms for returning the latch mechanisms 28, 29 to their locked position, besides the use of a timer, may be used. For example, the latch mechanisms 28, 29 may automatically return to their locked positions when the gate 10 is returned to its closed position.

Figure 4:
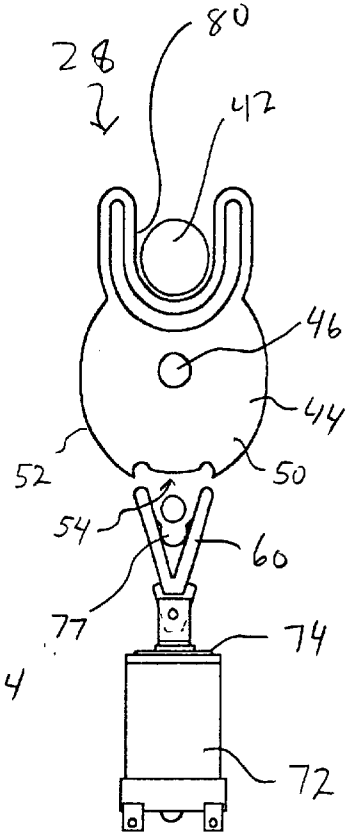
Figure 3:
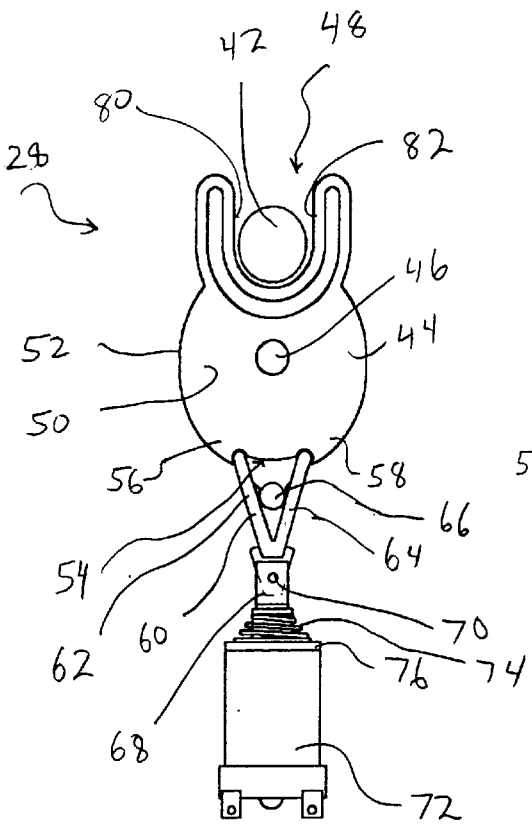

FIG. 3 illustrates one embodiment of a latch mechanism 28 in its locked, or latched, condition, and FIG. 4 illustrates the latch mechanism in its unlocked, or unlatched, condition. By the term "unlocked" it is meant that the cam 44 is free to rotate, and/or the pin 42 is not received in the cam 44 and therefore the gate 10 is free to pivot. By the term "locked" it is meant that the cam 44 is blocked from pivoting and the pin 42 is received in the cam 44 and therefore the gate 10 is locked in place. The cam 44 is located in its home position in FIG. 3 such that the notch 54 is aligned with the locking arm 60. In order to move the latch 28 to its unlatched or unlocked position, the solenoid 72 is activated to retract the piston 68, as shown in FIG. 4, thereby moving the arm 60 to its disengaged position. The solenoid 72 is preferably activated by a signal emitted by the actuator 32 (FIG. 1) received by the receiver 35 (FIG. 2). However, various other means or mechanisms for activating the solenoid 72 may be used. When the piston 68 is retracted as shown in FIG. 4, the arm 60 is pulled out of the notch 54, and the cam 44 is free to rotate about the center pin 46.

Figure 5:
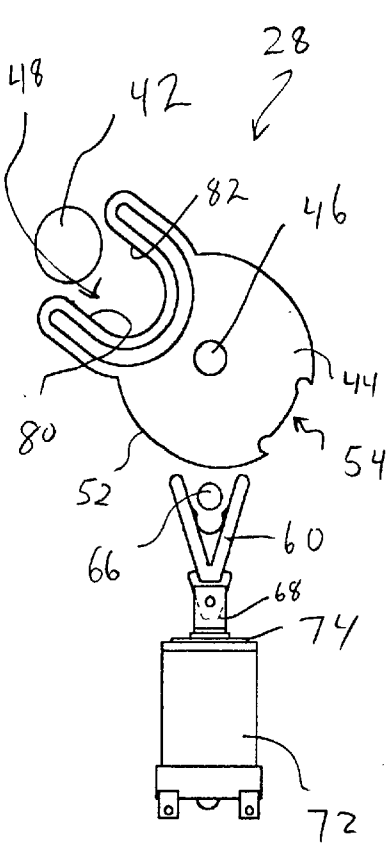

Once the latch 28 is shifted to its unlocked position, the gate 10 can be pivoted from its closed position. When the gate 10 is pivoted from its closed position, this moves the slot 48 relative to the pin 42 (i.e., moves the cam 44, arm 60 and solenoid 72 to the right in FIG. 4), which moves the pin out of the slot 48 as shown in FIG. 5. As the pin 42 moves out of the slot 48 of the cam 44, the pin 42 engages side 81 of the slot 48, thereby rotating the cam 44 about its center pin 46 to its position shown in FIG. 5. At this point, the cam 44 and the gate 10 are uncoupled from the pin 42 and wall portion 22, and the gate 10 is free to pivot to its fully opened position. After a predetermined period of time has elapsed, the power to the solenoid 72 is terminated, and the piston 68 extends outwardly to its engaged position shown in FIG. 6, as biased by the spring 74. The outward motion of the piston 68 causes the arm 66 to move into its engaged position such that the arm contacts the outer face 52 of the generally circular portion 50 of the cam 44.

Figure 7:
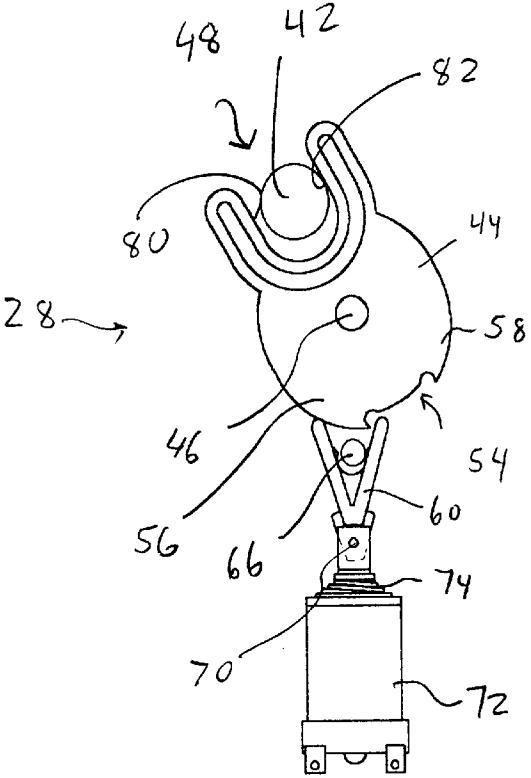
Figure 10:
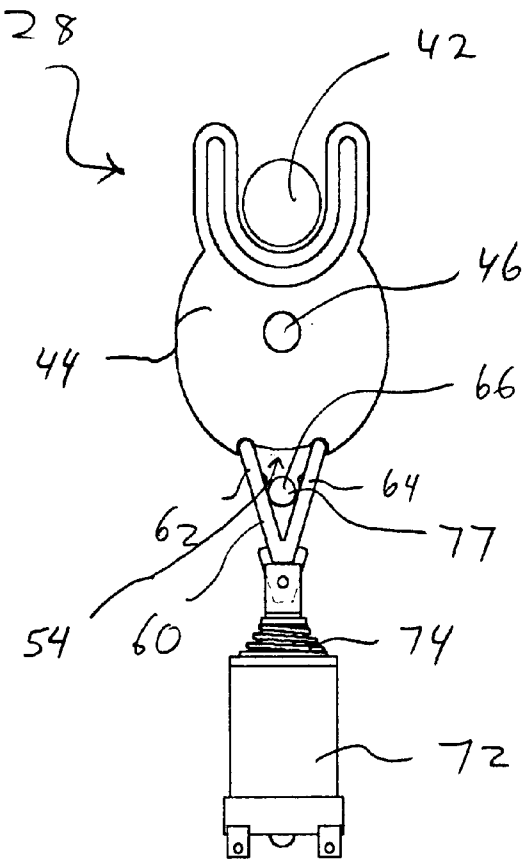

As shown in FIG. 7, when the gate 10 is swung into its closed position, the cam 44, arm 60 and solenoid 72 are moved to the left in FIG. 7. The pin 42 is then received in the slot 48 of the rotatable cam 44, and the pin 42 engages the side 82 of the slot 48. This causes the cam 44 to pivot towards its home position. Further movement of the cam 44 (to the left in FIG. 7) causes the cam to rotate about the center rod 46 to its position shown in FIG. 8. As the cam 44 is rotated, the legs 62, 64 of the locking arm 60 ride along the outer face 52. When the cam 44 begins to near its home position, the leg 64 is located over the notch 54 while the other leg 62 is located on the lobe 56 (FIG. 8). The lobe 56 acts as a guiding cam surface and causes the locking arm 60 to pivot slightly about the connecting pin 70, as indicated by arrow A, thereby urging the leg 64 into the notch 54 by a distance D (see FIG. 8A). As the cam 44 continues to near the home position, the leg 64 engages a side wall 55 of the notch 54, which pivots the locking arm about the connecting pin 70 as indicated by arrow B (FIG. 9). As the cam 44 continues to pivot, it reaches its home position shown in FIG. 10, and both legs 62, 64 are then fully received in the notch 54 as biased by the spring 74. The pin 66 is then received in a generally circular recess 77 in the arm 60, which prevents the arm from rotating. After the arm 60 is received in the notch 54, rotation of the cam 44 in either rotational direction is blocked, and the gate 10 is thereby latched in its closed position.

Figure 8A:
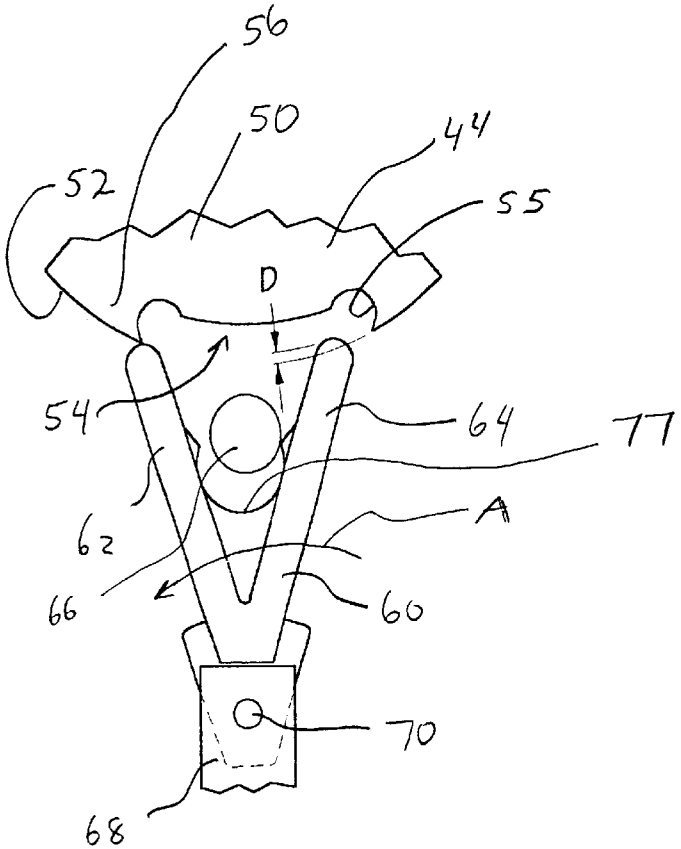
Figure 8:
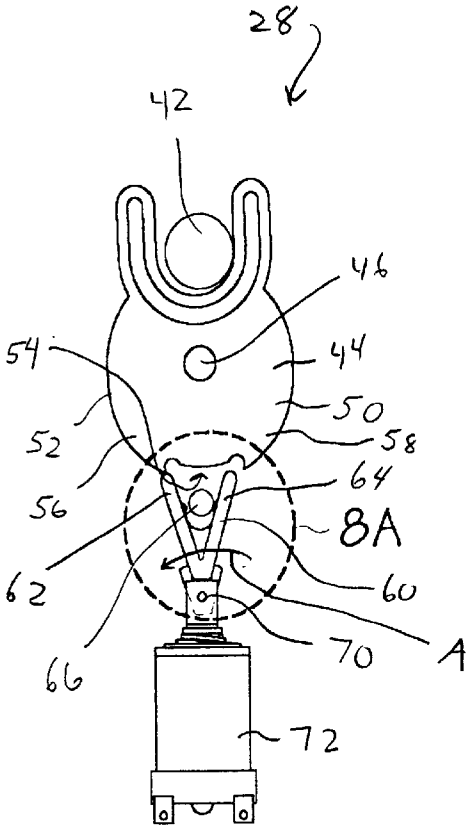
Figure 9:
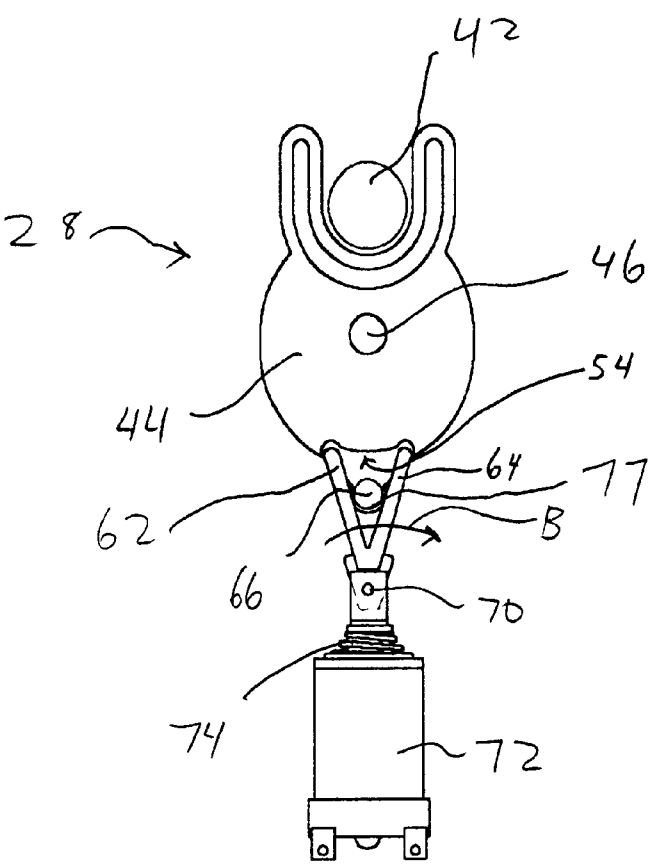

The lobes 56, 58 cause the locking arm 44 to rotate about the connecting pin 70 as the cam 44 nears its home position, and thereby ensure that the locking arm 44 engages one of the side walls of the notch 54 (see FIG. 8A). This, in turn, ensures that the locking arm 44 "catches" in the notch 54 as the gate 10 is swung towards its closed position. Thus, the illustrated latch mechanism 28 arrangement prevents the gate from "swinging through" the latch mechanism 28 and ensures that the latch mechanism catches the gate in the closed position.

The latch mechanism 28 illustrated herein may be used when the gate 10 is pivoted in either direction relative the latch mechanism. This provides the user a choice as to which way to swing the gate 10 after it is unlatched. Furthermore, the orientation of the latch mechanism 28 may be reversed such that the pin 42 is located on the gate 10 and the cam 44, locking arm 60 and the solenoid 72 and associated hardware are mounted onto the wall portion 22. The gate of the present invention may also be used to block the access of household pets, in which case the actuator is preferably located at a position inaccessible to the pets to prevent accidental activation.

Having described the invention in detail and by reference to the preferred embodiments, it will be apparent that modifications and variations thereof are possible without departing from the scope of the invention.

What is claimed is:

1. An infant safety gate comprising:

a gate member adapted to be pivotally mounted to a first generally vertical surface of a doorway opening such that said gate member is pivotable between an open position and a closed position to limit passage therethrough, said gate being sized such that said gate member spans a lower portion of said opening and does not span an upper portion of said opening;

a latch, at least part of said latch being located on said gate member or adapted to be located on a second generally vertical surface of said opening, said latch being actuatable between a locked position, wherein pivotable movement of said gate member is prevented, and an unlocked position wherein said pivotable movement of said gate member is permitted;

an actuator adapted to be mounted separately from said gate member for actuating said latch to said unlocked position, said actuator generating an infrared signal when activated, and wherein said latch includes a receiver for receiving said signal from said actuator and switching said latch to said unlocked position in response thereto, wherein said gate member is sized such that when said actuator is mounted adjacent to said doorway opening an operator can reach through said upper portion of said doorway opening to access and operate said actuator; and wherein said actuator includes an infrared emitter connected in line with an actuator transistor, an actuator controller for controlling an operative state of the actuator transistor, and a switch connected to the actuator controller, wherein the actuator controller is operable, in response to closure of the switch, to control the operative state of the actuator transistor to generate said infrared signal, said infrared signal comprising a coded multi-bit digital signal, wherein a digital 1 is represented by a 0.5 ms modulated pulse followed by a 0.5 ms delay and a digital 0 is represented by a 1.0 ms delay.

2. The gate of claim 1 wherein said receiver comprises an infrared detector connected to an input of a receiver controller, the latch including a solenoid connected to a receiver transistor, wherein the receiver controller monitors a state of the infrared detector to verify that a digital sequence of said coded multi-bit signal produced by the actuator and received by said detector matches a predetermined digital sequence, wherein the receiver controller is operable, in response to such verification, to turn the receiver transistor on resulting in energization of the solenoid.

3. The gate of claim 2 wherein the receiver controller turns the receiver transistor on with a constant applied voltage for a first period of time and thereafter applies a PWM voltage to the receiver transistor for a second period of time.

4. An infant safety gate comprising:

a gate member adapted to be pivotally mounted to a first generally vertical surface of a doorway-sized opening such that said gate member is pivotable between an open position and a closed position to limit passage therethrough, said gate being sized such that said gate member spans a lower portion of said opening and does not span an upper portion of said opening;

a latch, at least part of said latch being located on said gate member or adapted to be located on a second generally vertical surface of said opening, said latch being actuatable between a locked position, wherein pivotable movement of said gate member is prevented, and an unlocked position wherein said pivotable movement of said gate member is permitted, said latch connecting said gate member to said second surface when in said locked position;

an actuator adapted to be mounted separately from said gate member for actuating said latch to said unlocked position, said actuator generating a signal when activated, and wherein said latch includes a receiver for receiving said signal from said actuator and switching said latch to said unlocked position in response thereto, wherein said gate member is sized such that when said actuator is mounted adjacent to said doorway opening an operator can reach through said upper portion of said doorway opening to access and operate said actuator;

wherein said latch further includes a pin mounted on one of said gate member or adapted to be mounted on said second surface, a cam mounted rotatably on the other of said gate member or adapted to be mounted on said second surface, said cam including a slot shaped to receive said pin therein, and a locking arm mounted on the other of said gate member or adapted to be mounted on said second surface with said locking arm being movable into and out of engagement with said cam such that when said pin is retained in said slot and said locking arm engages said cam, said gate member is latched in said closed position;

wherein said cam has a home position wherein said pin is fully received in said slot, said cam being rotatable out of said home position to disengage said pin from said cam when said arm is not in engagement with said cam;

wherein said cam further includes a notch shaped to receive said locking arm, whereby said locking arm is movable to engage said notch to block rotation of said cam, and said cam also includes a lobe which forms a guiding cam surface, and said locking arm is positioned to slide against said guiding cam surface as said cam rotates, thereby guiding said locking arm into said notch when said cam is rotated to said home position; and wherein said arm is biased into engagement with said cam and rotation of said cam causes said lobe to cam against said arm, causing said arm to pivot into said notch when said cam approaches said home position.

5. An infant safety gate comprising:

a gate member adapted to be pivotally mounted to a first generally vertical surface of a doorway opening such that said gate member is pivotable between an open position and a closed position to limit passage therethrough, said gate being sized such that said gate member spans a lower portion of said opening and does not span an upper portion of said opening;

a latch, at least part of said latch being located on said gate member or adapted to be located on a second generally vertical surface of said opening, said latch being actuatable between a locked position, wherein pivotable movement of said gate member is prevented, and an unlocked position wherein said pivotable movement of said gate member is permitted, said latch connecting said gate member to said second surface when in said locked position;

an actuator adapted to be mounted separately from said gate member for actuating said latch to said unlocked position, said actuator generating a signal when activated, and wherein said latch includes a receiver for receiving said signal from said actuator and switching said latch to said unlocked position in response thereto, wherein said gate member is sized such that when said actuator is mounted adjacent to said doorway opening an operator can reach through said upper portion of said doorway opening to access and operate said actuator;

wherein said latch further includes a pin mounted on one of said gate member or adapted to be mounted on said second surface, a cam mounted rotatably on the other of said gate member or adapted to be mounted on said second surface, said cam including a slot shaped to receive said pin therein, and a locking arm mounted on the other of said gate member or adapted to be mounted on said second surface with said locking arm being movable into and out of engagement with said cam such that when said pin is retained in said slot and said locking arm engages said cam member, said gate member is latched in said closed position;

wherein said cam has a home position wherein said pin is fully received in said slot, said cam being rotatable out of said home position to disengage said pin from said cam when said arm is not in engagement with said cam;

wherein said cam further includes a notch shaped to receive said locking arm, whereby said locking arm is movable to engage said notch to block rotation of said cam; and wherein said locking arm includes a pair of legs shaped to be received in said notch to selectively prevent rotation of said cam.

6. The gate of claim 5 further comprising a pin mounted with said locking arm and positioned between said legs to limit pivotal movement of said locking arm.

7. An infant gate comprising:

a gate member having an end pivotally mountable to a wall portion such that said gate member is pivotable between an open position and a closed position wherein an opposite end of said gate member is located adjacent an opposing wall portion;

a latch for selectively securing said opposite end of said gate member to said opposing wall portion, said latch including a pin mounted on said gate member or said opposing wall portion and a rotatable cam including a slot to receive said pin therein and mounted on the other of said gate member or said opposing wall portion, said cam being shaped to receive said pin therein and being rotatable in a cam plane, said latch including a locking arm that is movable in said cam plane into and out of engagement with said rotatable cam to selectively prevent rotation of said cam;

wherein said cam has a home position wherein said pin is fully received in said slot, said cam being rotatable out of said home position to disengage said pin from said cam when said arm is not in engagement with said cam;

wherein said cam further includes a notch shaped to receive said locking arm, whereby said locking arm is movable to engage said notch to block rotation of said cam;

wherein said cam includes a lobe which forms a guiding cam surface, and said locking arm is positioned to slide against said guiding cam surface as said cam rotates, thereby guiding said locking arm into said notch when said cam is rotated toward said home position; and wherein said locking arm is pivotable, and wherein said arm is biased into engagement with said cam and rotation of said cam causes said lobe to cam against said arm, causing said arm to pivot into said notch when said cam approaches said home position.

8. The gate of claim 7 wherein said locking arm is mounted for reciprocating movement into and out of engagement with said cam.

* * * * *